United States Patent [19]

Klotz

[11] Patent Number: 4,893,370

[45] Date of Patent: Jan. 16, 1990

[54] HAND TOOL FOR CLEANING SMOOTH SURFACES, IN PARTICULAR PANES OF GLASS

[76] Inventor: Manfred Klotz, Friedrich-List-Str. 25, 4790 Paderborn, Fed. Rep. of Germany

[21] Appl. No.: 203,191

[22] Filed: Jun. 7, 1988

Related U.S. Application Data

[63] Continuation-in-part of Ser. No. 60,570, Oct. 3, 1987.

[30] Foreign Application Priority Data

Oct. 7, 1986 [DE] Fed. Rep. of Germany ..... 8627272
Jul. 16, 1987 [DE] Fed. Rep. of Germany ..... 8709764

[51] Int. Cl.[4] ..... A47L 13/14

[52] U.S. Cl. ..... 15/121; 15/144 R; 15/172; 15/244.2; 15/245; 403/55; 403/58; 403/93

[58] Field of Search ..... 15/121, 172, 144 R, 15/144 A, 245, 244.1, 244.2, 244.4; 403/55, 58, 93, 94, 96

[56] References Cited

U.S. PATENT DOCUMENTS

| | | | |
|---|---|---|---|
| 1,687,953 | 10/1928 | Starks | 403/58 |
| 2,013,963 | 9/1935 | Ingling | 403/93 |
| 3,717,896 | 2/1973 | Chase et al. | 15/144 A X |
| 4,658,461 | 4/1987 | Roe et al. | 15/144 R X |

FOREIGN PATENT DOCUMENTS 8532656 1/1986 Fed. Rep. of Germany .

*Primary Examiner*—Peter Feldman
*Attorney, Agent, or Firm*—Browdy and Neimark

[57] ABSTRACT

A hand tool for cleaning smooth surfaces having a holder in the form of a flat box; a sponge block and a squeegee, spaced apart from and parallel to the sponge block; a swivelable handle disposed on the holder, on an incline and laterally about an axis extending vertically to the holder and an axis extending parallel to the holder, with two joints, disposed one above the other, with both joints locked in a particular handle position by a common locking and unlocking element in the form of a bolt-shaped and/or bush-shaped slide.

26 Claims, 11 Drawing Sheets

8
SG
15
14
16
6a
30
34
DG
6
7
39
36
7a
7
32b
32a
32
10
1
3
40
38
41
2
4
11

6
39
36

14
8
11
SG
15
16
6a
30
5
DG
7
6
39
32
10
40
38
7a
41
36

8
4
14
15
16
31
35
7
5
11
6
33
37
10
1
39
10a
42
43
44
DG
SG
7a
37/39

HAND TOOL FOR CLEANING SMOOTH SURFACES, IN PARTICULAR PANES OF GLASS

CROSS REFERENCE TO RELATED APPLICATION

The present application is a continuation-in-part of PCT application No. PCT/EP87/00570 filed Oct. 3, 1987, the entire contents of which are hereby incorporated by reference.

BACKGROUND OF THE INVENTION

The invention relates to a hand tool for cleaning smooth surfaces, in particular panes of glass, having a holder in the form of a flat box, a sponge block, and a squeegee, spaced apart from and parallel to the sponge block. A handle disposed on the holder is swivelable, on an incline and laterally about an axis extending vertically to the holder and an axis extending parallel to the holder, with two joints, disposed one above the other. A glass cleaning tool of this kind has become known from German Utility Model No. 85 32 656. The two joints are locked by means of spring-loaded balls and knurled ratchets in the particular handle positions set.

If major forces are exerted upon the handle, unintentional displacement of the handle is not precluded, because the springloaded balls are pressed out of the knurled ratchets, and so this known handle locking means functions inadequately.

SUMMARY OF THE INVENTION

It is the object of the invention to simplify a hand tool of the type described above in terms of the locking of the handle in both set positions, and to embody it reliably and to use only a single locking element for both joints, so that there are fewer individual parts.

The invention has created a locking means for the laterally and inclinationally adjustable handle which is extremely simple and reliable in design, and which functions with a slide element that fixes both joints simultaneously and engages teeth of the one joint and grooves of the other joint and as a result securely holds the handle in its set position even if major forces are exerted upon the handle.

The adjustment is extremely convenient and done by displacing the slide into the releasing position and then pushing it into the locking position.

The hand tool is also equipped with holder corners that are favorably recessed on the outside and with a squeegee protruding beyond them, so that even the corners of panes of glass can be cleaned satisfactorily.

The squeegee is interchangeably disposed in the holder and can be replaced quickly with simple manipulations.

To increase the cleaning action, this hand tool has a sponge element, which is formed in one piece from two portions of the sponge having different firmness, the firmer portion of the sponge effecting better loosening of adhering dirt and the softer portion of the sponge providing good scraping off of the dirt. On the one hand, the invention is considered to reside in the particular embodiment of the handle adjustment and locking means, the interchangeable squeegee fastening, he shaping of the corners of the holder, and the embodiment of the sponge block, and on the other hand in the cooperation of these aforementioned characteristics.

It is also the object of the invention to simplify adjusting the handle in both directions by providing a one-hand actuation of the handle and of the locking and unlocking slide, and to attain an automatic return of the slide into the locking position.

By means of the embodiment of the slide, which is subject to spring action, the slide simultaneously enables one-hand adjustment when the handle is gripped, in that it is pushed counter to the spring force into the unlocked position, whereupon the handle is then adjustable in both directions, and after the slide is released, it moves automatically and quickly back into the locking position under the spring force, and it is reliably held in this position by the spring so that unintentional displacement is precluded.

The slide and its spring assembly are embodied simply and economically and make handling of the cleaning tool easier and better.

A further object of the invention is to simplify and securely embody the locking of the handle in both set positions and to enable adjustment of the handle by the user with one hand, as well as to attain an automatic motion of the joints into the locking position by means of a favorably embodied and disposed restoring element.

The invention has created a jointed head for the handle which is laterally and inclinationally adjustable; this head is extremely simple and reliable and functions with a locking bush as a rotary joint and with a locking extension as a swivel joint, both joints being automatically movable into the locking position by a common spring and held thereby in this position.

As locking means, tooth-like protrusions are provided on the locking extension, which securely engage locking grooves of the bolt-like rotary-joint axis over a large surface area.

As the locking means, rib-like or tang-like protrusions are disposed on the locking bush and holes are disposed in the holder; alternatively, teeth that mesh with one another are disposed on the locking bush and in the holder, once again assuring secure engagement over a large surface area. The spring disposed about the rotary-joint axis, as a compression spring, securely and firmly holds both joints in their locking positions and at the same time effects an automatic motion of the joints into the locking positions.

The adjustment of the handle can be performed with one hand, in that the user grasps the handle and with his fingers exerts pressure upon the holder counter to the spring force, so that the handle is displaced relative to the holder into the unlocking position, and the adjustment can be performed as desired.

Upon the release of the holder, the spring then moves both joints back into the locking positions automatically and simultaneously.

BRIEF DESCRIPTION OF THE DRAWINGS

In the accompanying drawings, exemplary embodiments of the invention are shown, which will be described in further detail below in which.

DETAILED DESCRIPTION OF THE EMBODIMENTS

Figure 1:
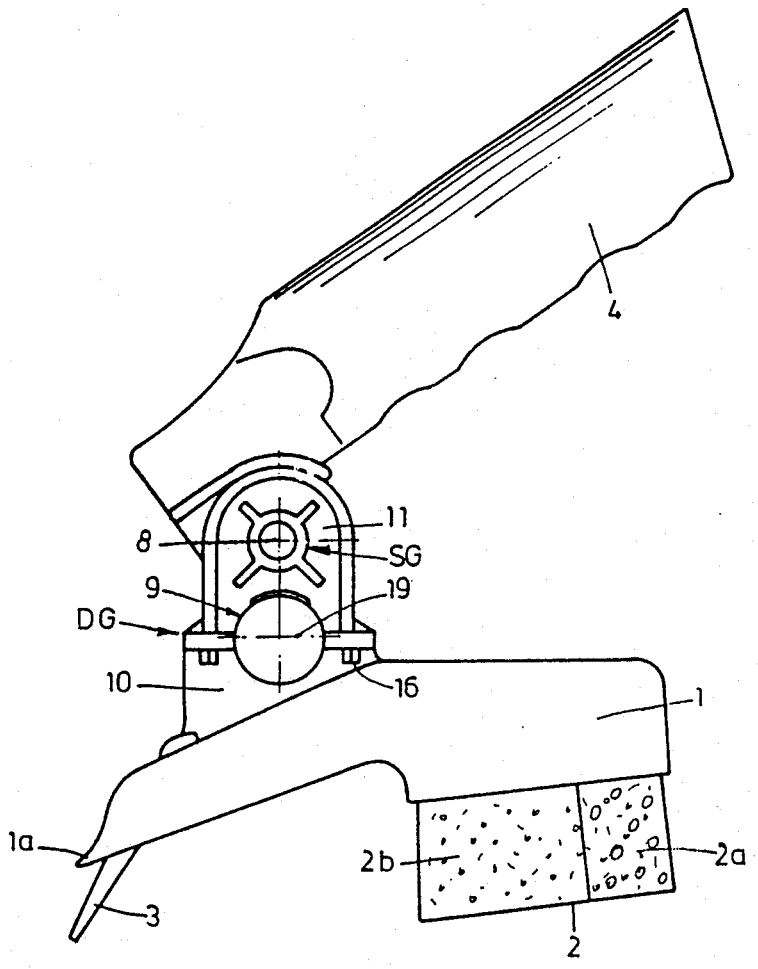
FIG. 1 is a side view of a hand tool having a sponge block releasably held on a holder and having a squeegee as well as a handle provided to be adjustable in terms of both its inclination and its lateral position.

In the figures are shown a preferably elongated holder 1, in the form of a flat box, of a hand tool for cleaning smooth surfaces, in particular panes of glass, which has a sponge block 2, and spaced from it and parallel to it, an either interchangeable or fixed squeegee 3.

Disposed on this holder 1 is a handle 4 such that it is adjustable, with two joints (SG, DG) disposed one above the other, in inclination and laterally about axes 7, 8, one extending vertically and one extending parallel to the holder 1. According to the invention both joints (SG, DG) are lockable in the particular handle position by a common slide 9.

The slide 9 is on the one hand displaceable parallel to the inclination-adjusting axis 8, and on the other hand is swivelable with the lateral swiveling axis 7, and is located between the two axes 7, 8, which are disposed spaced apart one above the other.

The lower joint (DG) effecting the lateral swiveling of the handle, is embodied as a bearing body that is embodied by a joint sleeve 45, forming the vertical swivel axis 7 and rotatably inserted into a bearing bush 10 of the holder 1, and a bearing fork 11 protruding above this joint sleeve 45, and by a guide channel 12 for the slide 9.

The sleeve 45 of the lower joint (DG) can be locked behind the bearing bush 10 by means of a detent collar 13, which is integrally formed onto the face end of the sleeve opposite the bearing fork 11, as a result of which the sleeve 45 is positionally fixed in the axial direction and is rotatably retained in the bearing bush 10.

The upper joint (SG) effecting the inclinational swiveling of the handle 4 has a swivel wheel 14 integrally molded onto the handle 4 and having teeth 15 on its jacket, and this swivel wheel 14 is swivelably held in the bearing fork 11 with the parallel axis 8, formed by a bolt or the like.

The bearing bush 10 integrally formed onto the holder 1 has, on its face end oriented toward the handle 4, a plurality of grooves 16 distributed uniformly over its circumference (see FIGS. 4–8 and 19, 20), and the slide 9 has a lower locking rib 17, with which it engages at least one, preferably two facing grooves 16 for locking of the lower joint (DG).

The slide 9 also has an upper locking rib 18, with which for simultaneous locking of the upper joint (SG) it grips in between two teeth of the teeth 15—that is, it engages the groove 15*a* formed thereby.

The slide 9 of FIGS. 1–7 has a polygonal, preferably rectangular bar cross section and at both ends of the bars has one actuation head 19 each; these two actuation heads 19 at the same time form a limitation stop for the two displacement end positions of the slide 9, by cooperating with the guide channel 12.

Between the actuation heads 19 and the two locking ribs 17, 18 provided on the slide bar 9*a*, recesses 20, 21 are provided, which unlock the locking of the slide 9 for the adjustment of the two joints (SG, DG); that is, they permit a rotation of the sleeve 45 relative to the bearing bush 10 with the slide 9 and at the same time permit swiveling of the handle 4 with its swivel wheel 14 relative to the slide 9.

The guide channel 12 is for instance disposed horizontally in the bearing bush 10 and extends with its other part in the bearing fork 11 and has a cross section adapted to the slide bar 9*a*, which is preferably in the form of a U and is open at the top toward the swivel wheel 14.

The lower joint (DG), comprising the sleeve 45, the guide channel 12 and the bearing fork 12, is made in one piece from plastic. The swivel wheel 14, having teeth 15, that embodies the upper joint (SG) is formed from plastic onto the handle 4, and the slide 9 is likewise made from a plastic part.

The flat-box-shaped holder 1 is also made in one piece from plastic.

Figure 6:
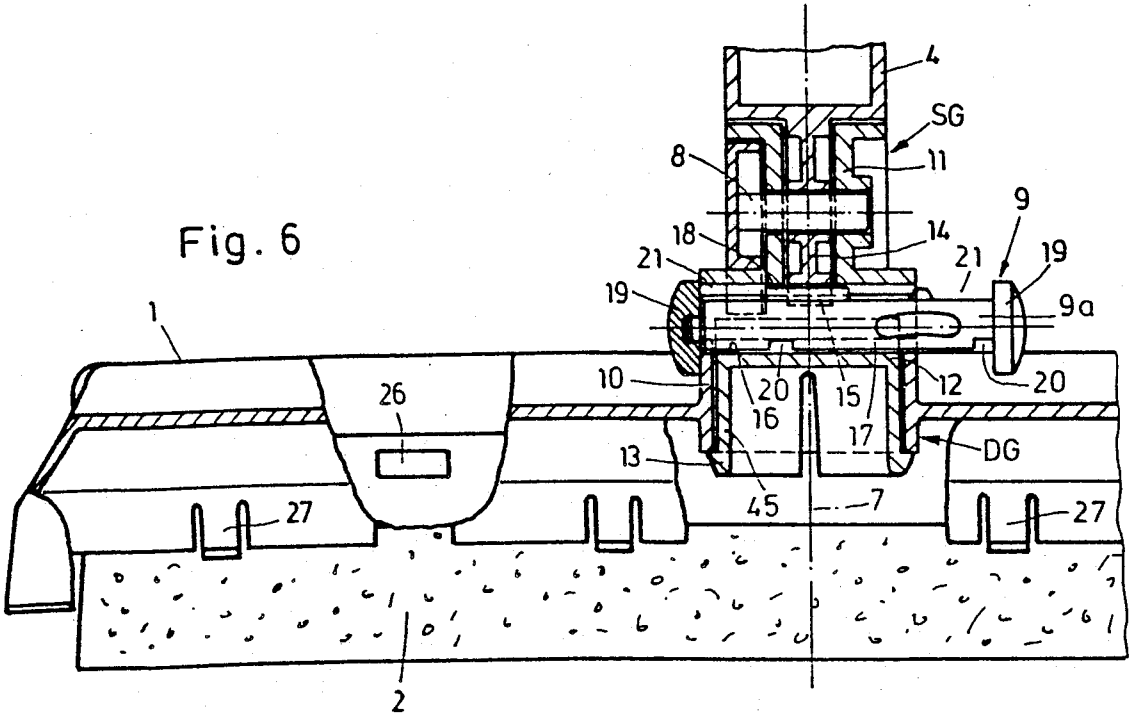
FIG. 6 is a fragmentary longitudinal section through the hand tool showing the joints and the slide for adjusting the handle, on a larger scale.

In FIG. 6, the locking position of the slide 9 is shown, in which with its upper locking rib 18 it grips in between two teeth 15 of the swivel wheel 14—in a groove 15*a* (see also FIG. 7)—and at the same time, with its lower locking rib 17, it engages two opposed grooves 16 of the bearing bush 10. One actuating head 19 rests on the face end of the guide channel 12, and the releasing recesses 20, 21 are located outside the grooves 16 for teeth 15.

Figure 7:
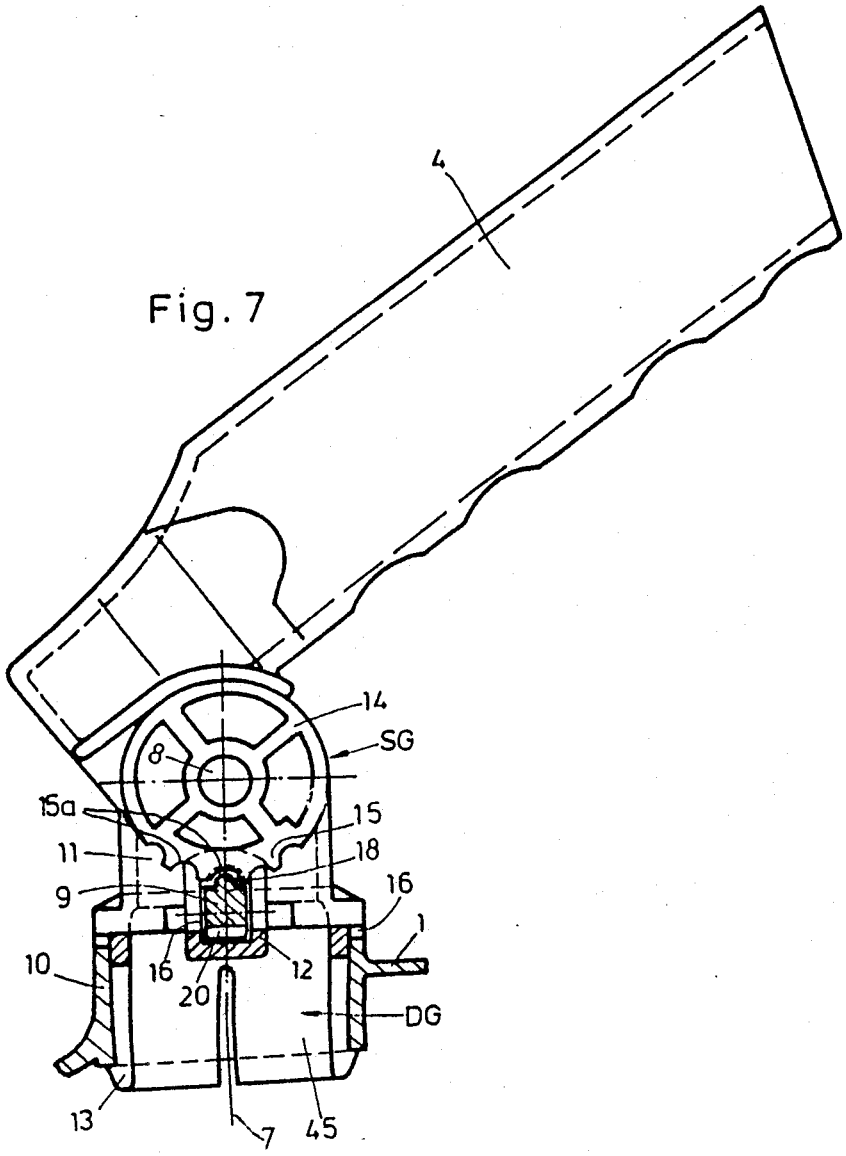
FIG. 7 is a side view, partially cut away, of the handle showing the joints, on a larger scale.

The same locking position can also be seen in FIG. 7.

For the locking the handle 4, the slide 9 is now displaced out of this locking position, toward the left as seen in FIG. 6, so that the second actuating head 19 now strikes the guide channel 12, and the two lower recesses 20 are now located about the bearing bush 10, so that the lower locking rib 17 extends in the bearing bush 10, thereby enabling an axial rotation of the handle 4 about the axis 7. At the same time, the upper locking rib 18 has been pushed out of the teeth 15 of the swivel wheel 14, and the upper recess 21 allows the swivel wheel 14 to move freely about the axis 8 in order to adjust the inclination of the handle 4.

Once the desired inclination setting and lateral swiveling of the handle 4 have been attained, the slide 9 is displaced back in the opposite direction again, and with its locking ribs 17, 18 it lockingly engages the grooves 16 and the teeth 15. By means of these two joints (SG, DG) and the slide 9, an infinitely variable adjustment of the handle 4 in the aforementioned two directions is possible.

The squeegee 3 is retained interchangeably on the holder 1 with a formed-on profile edge or profile bead 22 behind retaining strips 23 of the holder 1 and by means of a clamping strip 24 of angular cross section that grips the profile edge 22 from below; this clamping strip 24 extends over virtually the entire length of the squeegee 3 and is inserted into the holder 1 from the side that is open at the bottom and simultaneously acts as the cleaning side, having the squeegee 3 and the sponge block 2, the clamping strip being releasably fixed with at least two formed-on release buttons 25 in guide recesses 26 of the holder 1.

Figure 8:
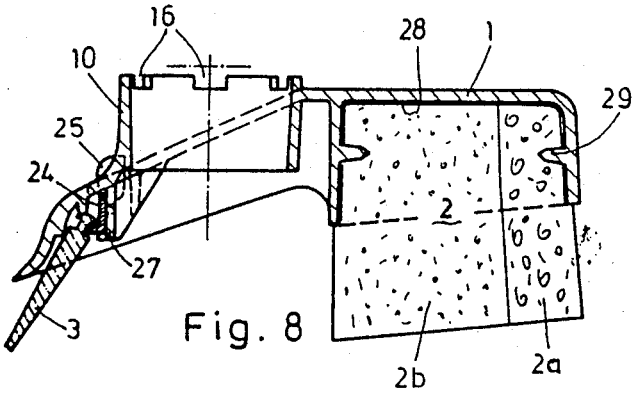
FIG. 8 is a cross section through the hand tool, without the joints and showing the squeegee fastening.
Figure 9:
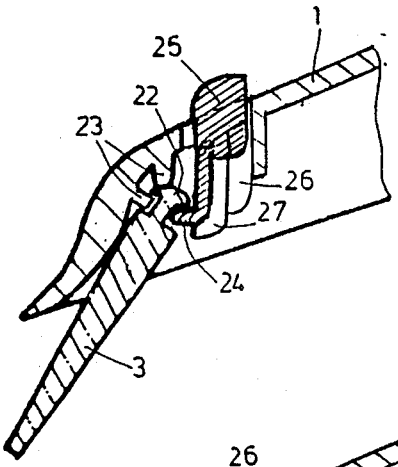
FIG. 9 is a cross section through a portion of the holder with the squeegee fastened in place.
Figure 10:
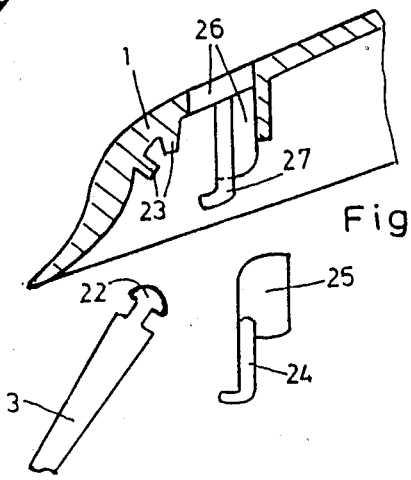
FIG. 10 is a cross section through the holder with the squeegee released.

These release buttons 25 protrude at the top out of the holder 1, for actuating the clamping strips 24 into the release position (see FIGS. 8–10).

Detent ribs 27 are also formed onto the holder 1 next to the guide openings 26, grasping the clamping strip 24 from behind and below and holding it in the clamping position, in which the clamping strip 24 engages the profile edge 22 from behind and presses it against the retaining strips 23 as shown in FIG. 9.

By pressure from above onto the release buttons 25, the clamping strip 24 is pressed downward via the detent ribs 27, and releases the squeegee 3 from its locked position so that it can be changed as shown in FIG. 10.

The holder 1 is extended outward in curved fashion on its two corners 1*a* toward the squeegee, where it forms a protrusion 1*b* extending relatively far outward.

Figure 2:
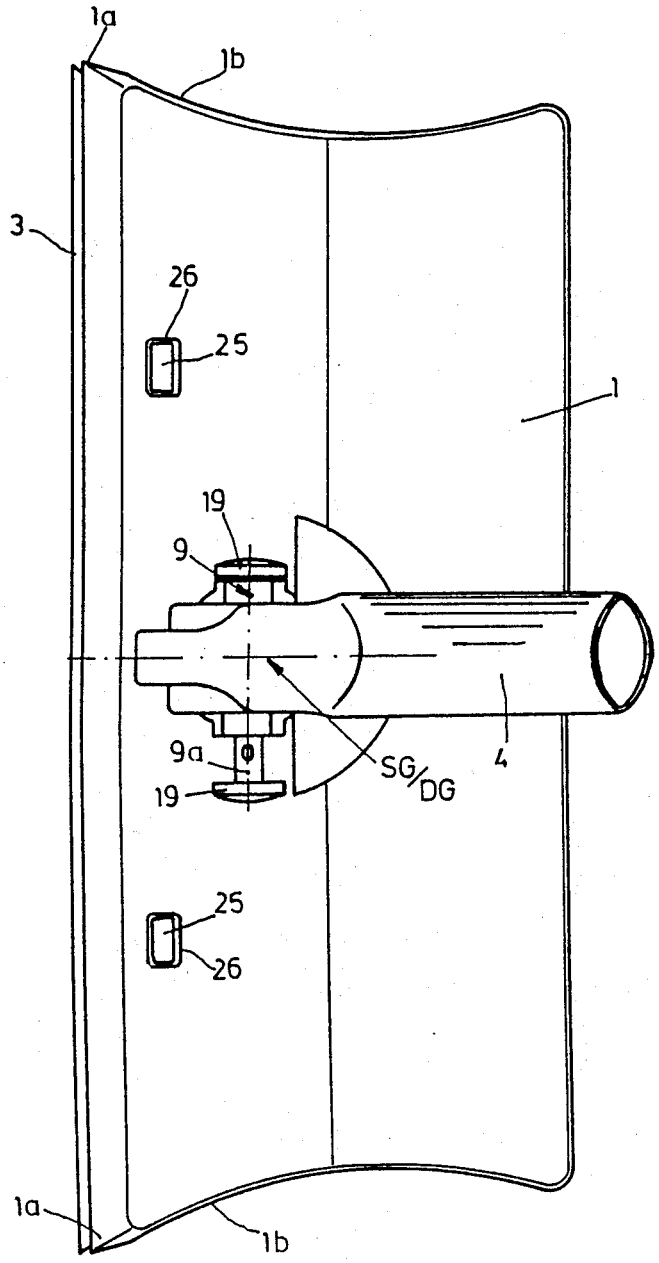
FIG. 2 is a plan view of the same hand tool.
Figure 3:
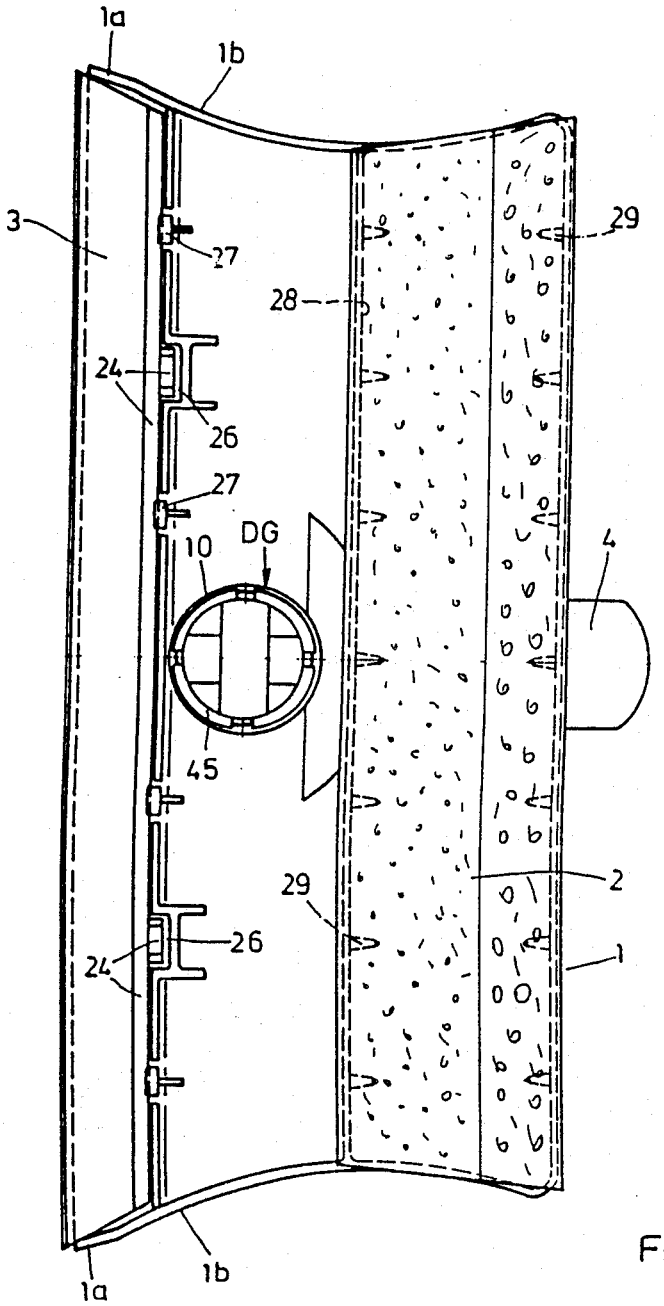
FIG. 3 is a view of the hand tool from below.
Figure 4:
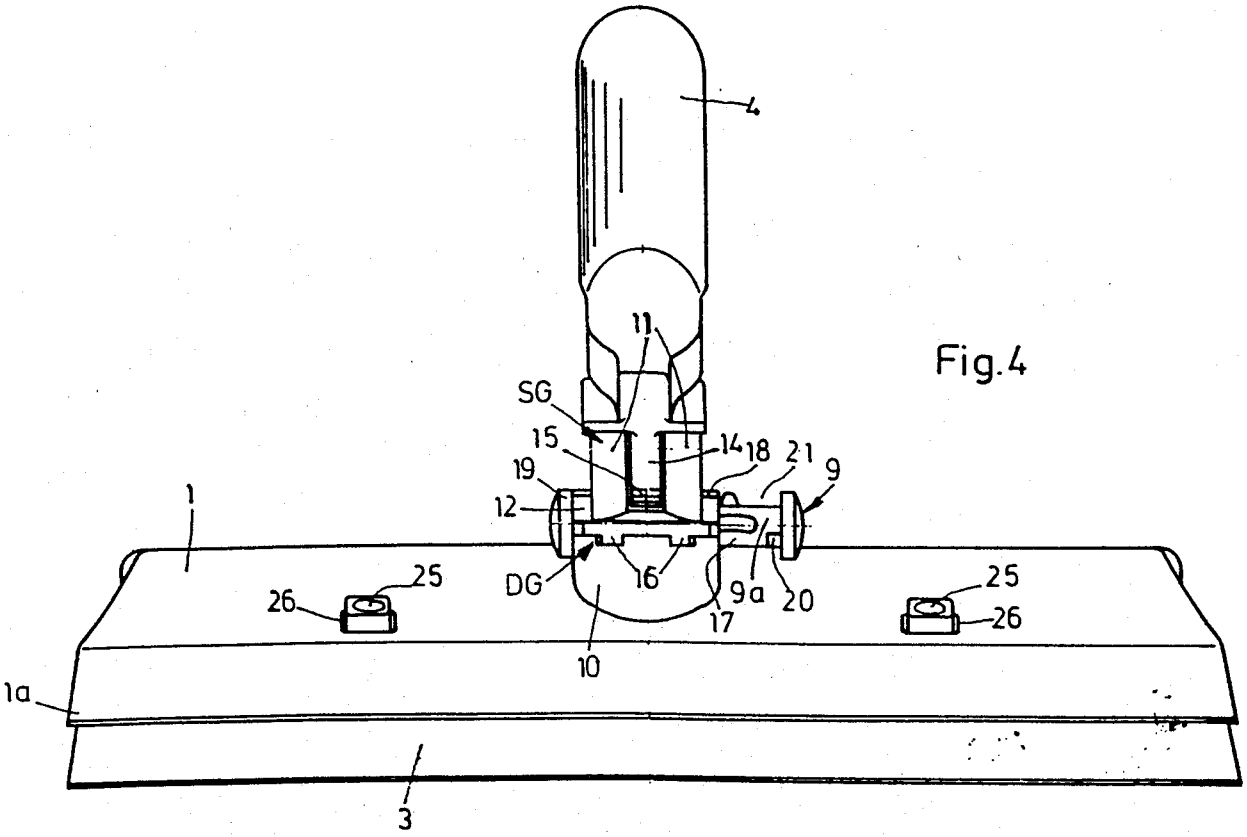
FIG. 4 is a front view of the hand tool.
Figure 5:
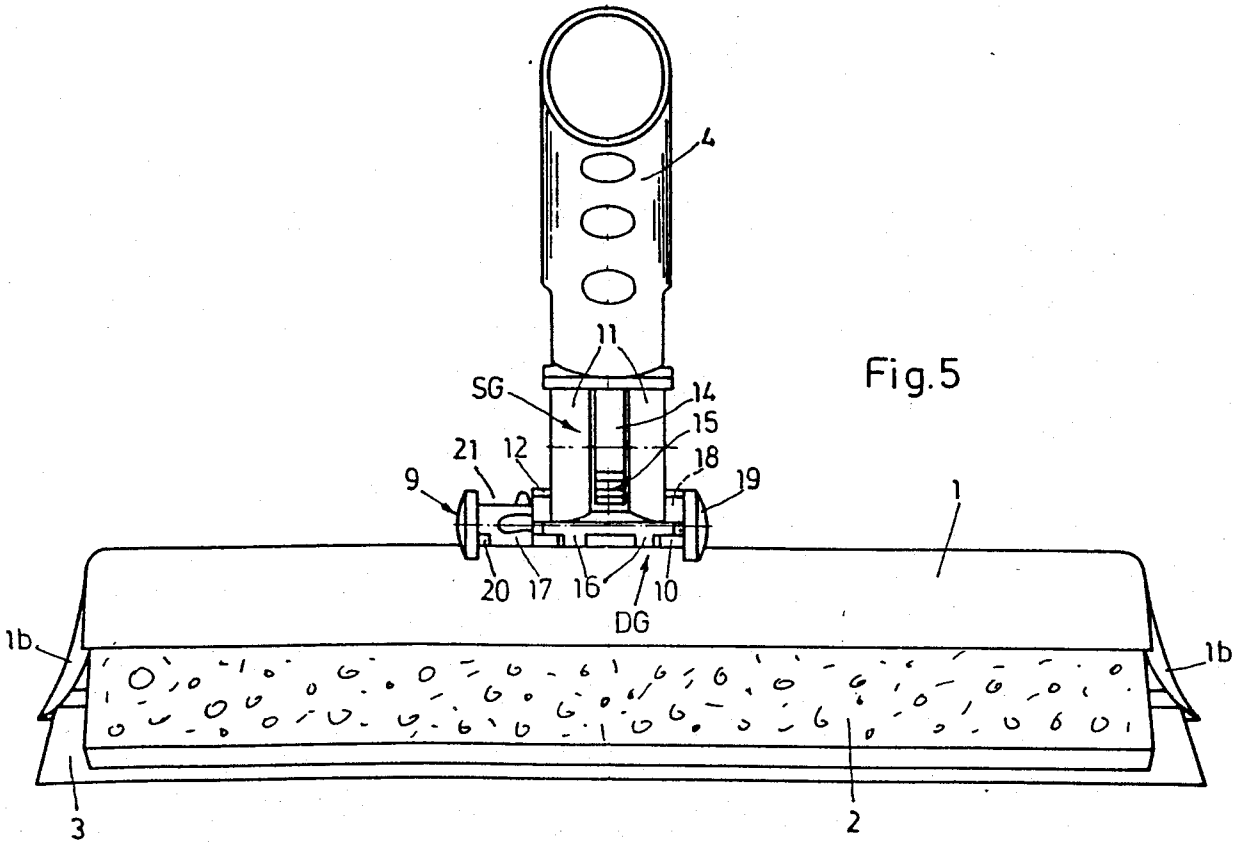
FIG. 5 is a back view of the hand tool.

The squeegee 3 is additionally extended laterally with its ends beyond these holder corners 1*a*, to enable simple and reliable cleaning of even the corner regions of glass panes as shown in FIG. 2 and 3.

The one-piece block of sponge 2 interchangeably secured in the holder 1 is embodied of two sponge portions 2*a*, 2*b* of different firmness, of which the sponge portion 2*a* remote from the squeegee 3 is embodied as intrinsically firmer and has a greater frictional and cleaning action.

This sponge block 2 is inserted from the open side of the holder 1 into a receiving space 28 of the holder 1 in which it is releasably fixed by formed-on retaining teeth 29.

In general, it should be noted that the hand tool, in particular a glass cleaning tool, has a locking device for a holder 1, guided with the adjustable handle, the holder having a rotary and swivel joint (DG, SG) disposed between the holder 1 and the handle 4 and provided with locking elements. In order to enable making the locking device and hence the handle 4 both swivelable and rotatable with respect to the holder 1, on the condition that the locking or unlocking of the joint (DG, SG) can be accomplished with a single manipulation for both rotation and swiveling, the handle 4 is provided with a swivel wheel 14 provided with teeth 15, which is swivelably supported about an axis 8, extending transversely to the axis 7 of a sleeve 45, the sleeve 45 being supported, rotatably about an axis 7, in a bearing bush 10 of the holder 1. In the vicinity of the upper edge of the bush 10, as well as of the sleeve 45 located in this region and the fork-like extension 11 extending in this region is a locking and unlocking slide 9 that passes through these elements, is provided with locking elements, and is parallel to the axis 8. Depending on the locking or unlocking position, the slide 9 protrudes out of the joint (DG, SG) to one side or the other.

Because of the inclinational and rotational embodiment of the joints (DG, SG), the sponge 2 is purposefully embodied with two wiping regions and a wiping blade with a particular embodiment of the corners and such that it is interchangeable. In accordance with the further embodiment of the hand tool of FIGS. 11–18, the two joints (SG, DG) are brought into the locking position and held therein by a common spring 5. The rotary joint (DG) is embodied by a locking bush 6 and the swivel joint (SG) embodied by the locking extension 14, and the spring 5 is disposed about the rotary joint axis 7.

As the rotary joint axis 7, a bolt is positionally fixed in the bearing bush 7 of the holder 1, and the spring 5 is disposed about it, being supported with one end on a bolt abutment 30, 31 and with the other end on an abutment 32, 33 of the locking bush 6.

The locking extension 14 is formed onto the handle 4 and has a semicircular form, with teeth 15 uniformly distributed over the semicircle, as locking elements, which cooperate with recessed locking grooves 16, as counterpart detent elements, on an extension 34 or bush 35 of the bolt 47, this extension 34 or bush 35 forming a part of the bolt 47 and protruding out of the locking bush 6.

The gearwheel-like locking extension 14 of the handle 4 is supported in a fork portion 11 of the locking bush 6, being swivelably supported in this fork portion 11 by the horizontal axis 8 and being connected via the fork portion 11 with the locking bush 6.

With its locking extension 14 and the locking bush 6, the handle 4 is provided to be displacable in the longitudinal direction of the bolt 47 in and counter to the spring 5, and with the locking bush 6 it is retained in the bearing bush 10 such that it is rotatable about the bolt 47.

The swiveled handle position is locked by means of the cooperating locking elements 15, 16, and the rotated handle position is fixed by means of locking elements 36, 37 formed onto the locking bush 6, and counterpart locking elements 38, 39 provided in the holder 1. The spring 5 is operative for both locking positions.

Figures 11, 12, 13:
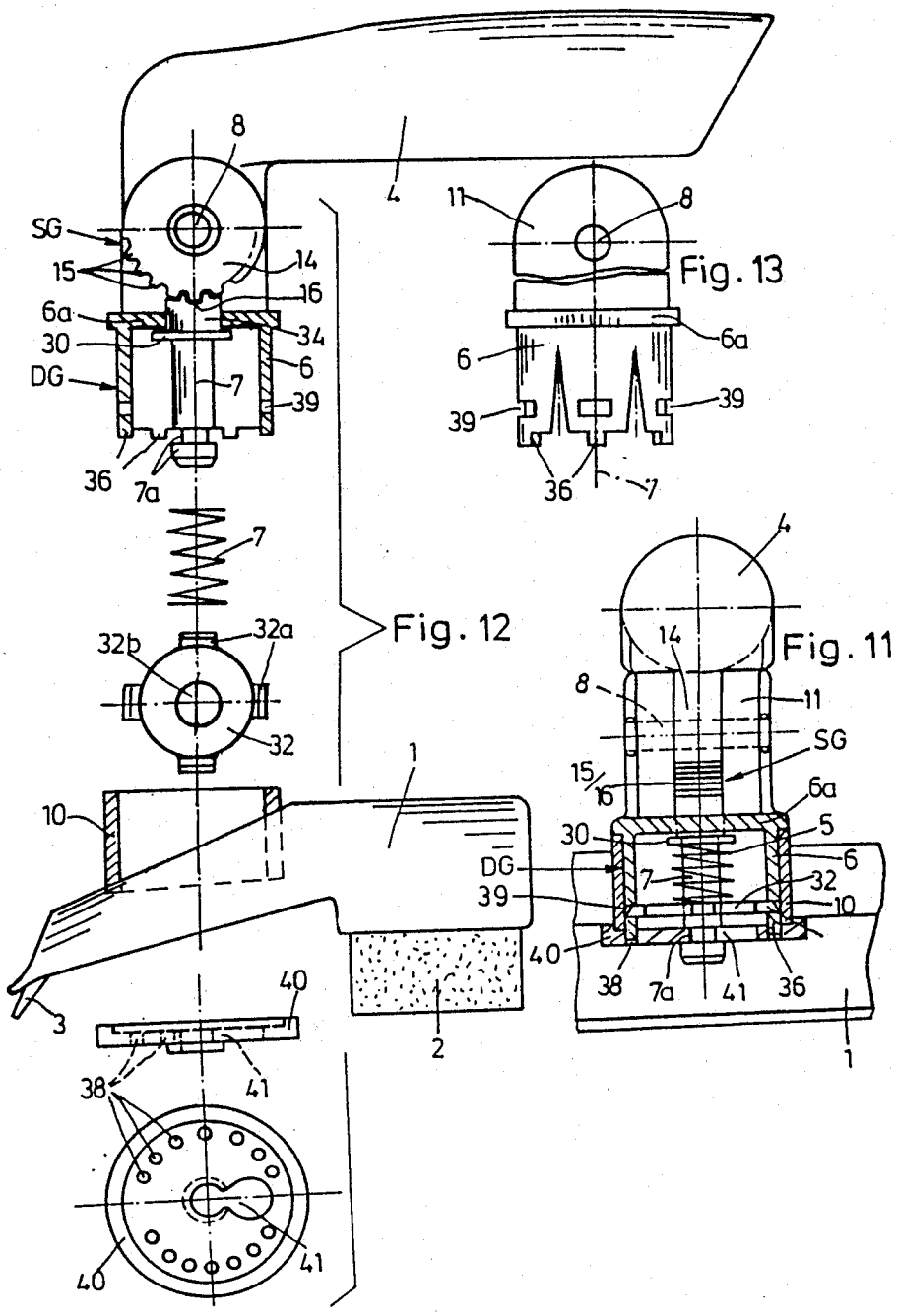
FIG. 11 is a front view, in fragmentary section, of a jointed head between the handle and the holder in a further version of the manual cleaning tool.
FIG. 12 is a side view, in fragmentary section and in an exploded view showing the individual parts of the hand tool.
FIG. 13 is a side view of a locking bush of the hand tool.

In the embodiment of FIGS. 11–13, the locking bush 6 is cup-shaped and its cup bottom 6*a*, located at the top, is supported in the locking position on the bolt abutment 30 and at the same time supports the fork portion 11.

Spaced apart from the bush end open at the bottom, an abutment washer 32 is locked in detent fashion in the locking bush 6, with jacket protrusions 32*a* engaging jacket recesses 39 in the locking bush 6 and with a central hole 32*b* encompassing the bolt 47. Supported on this abutment washer 32 is the spring 5, which with its other end presses against the collar-like abutment 30 of the bolt 47.

Formed onto the free face end of the bush are detent protrusions 36 oriented in the direction of the bush axis, which engage detent recesses 38 of a lock washer 40, fixed in the holder 1 below the bearing bush 10, in every rotated position.

The detent protrusions 36 are embodied by ribs or tangs, and the detent recesses 38 are embodied as holes, and both locking elements 36, 38 are disposed on a circular arc, distributed at equal intervals over the circumference. The lock washer 40 overlaps the top of the lower face end of the bearing bush 10 and with a keyhole-like recess 41 is slipped onto an annular groove extension 7a of the bolt 7, so that the bolt is positionally fixed in the holder 1 by the lock washer 40.

The modified embodiment of the jointed head on the hand tool of FIGS. 14–17 is equivalent in its basic principle and in function to the jointed head of FIGS. 11–13. Once again, the locking bush 6 is cup-shaped and below its cup bottom 33, which is at the bottom, and simultaneously forms the abutment for the spring 5, has an encompassing inner toothed portion 37, which as a toothed ring forms the locking elements.

The bearing bush 10 on the holder 1 is cup-shaped, and outer teeth 39 are provided on its cup bottom 10a, and this outer toothed ring represents the locking elements cooperating with the inner toothed ring 37 of the locking bush 6, and the teeth 37, 39 mesh with one another in every rotated position of the handle 4.

The bolt 47 passes through the cup bottom 10a of the bearing bush 10 and is fixed in the bearing bush 10 by means of a securing ring 47 engaging its annular groove extension 7a and supported beneath the cup bottom 10a.

Formed onto the upper end of the bolt 47 is a cup-shaped bush 35, which in itself forms the abutment 31 for the spring 5 and on the outside has the locking grooves 16.

The spring 5 is embodied as a helical spring, in a preferred manner, and functions as a compression spring.

In the locked position (see FIGS. 11 and 14), the spring 5 presses against the two abutments 30, 31 and 32, 33, as a result of which the handle 4 engages the locking grooves 16 with its locking extension 14, and the locking bush 6, with its locking elements 36, 37 meshes with the locking means 38, 39, so that the swiveled and rotated handle position is fixed.

For adjustment of the handle 4, the handle 4 is displaced in the longitudinal direction of the bolt 47 counter to the spring force 5, with respect to the holder 1, so that the spring 5 is compressed between the abutments 30 and 32 or 31 and 33, and the locking protrusions 15 of the extension 14 emerge from the locking grooves 16 of the fixed bolt 47. At the same time, the locking protrusions 36 or 37 emerge from the locking protrusions 38 or 39, since the locking bush 6 has been carried along in the longitudinal direction of the bolt as well, along with the handle 4.

The handle 4 can now be rotated about its swivel axis 8 in its inclination and at the same time, with its bush 6 in the bearing bush 10, can be rotated about the axis 7 in each case into the desired position.

The spring 5 then pulls the two joints (SG, DG) back into the locking position, in that the locking protrusions 15 engage the locking grooves 16, and the locking protrusions 36, 37 mesh with the locking protrusions 38, 39.

This adjustment can be done with one hand, in that the hand surrounds and grasps the handle 4 and the fingers press on the holder 1 counter to the spring force 5, to enable the axial displacement and rotation of the handle 4 relative to the holder 1.

With the release of the handle 1, the spring 5 automatically presses the two joints (SG, DG) into the locking positions.

Figures 14, 15, 16, 17, 18:
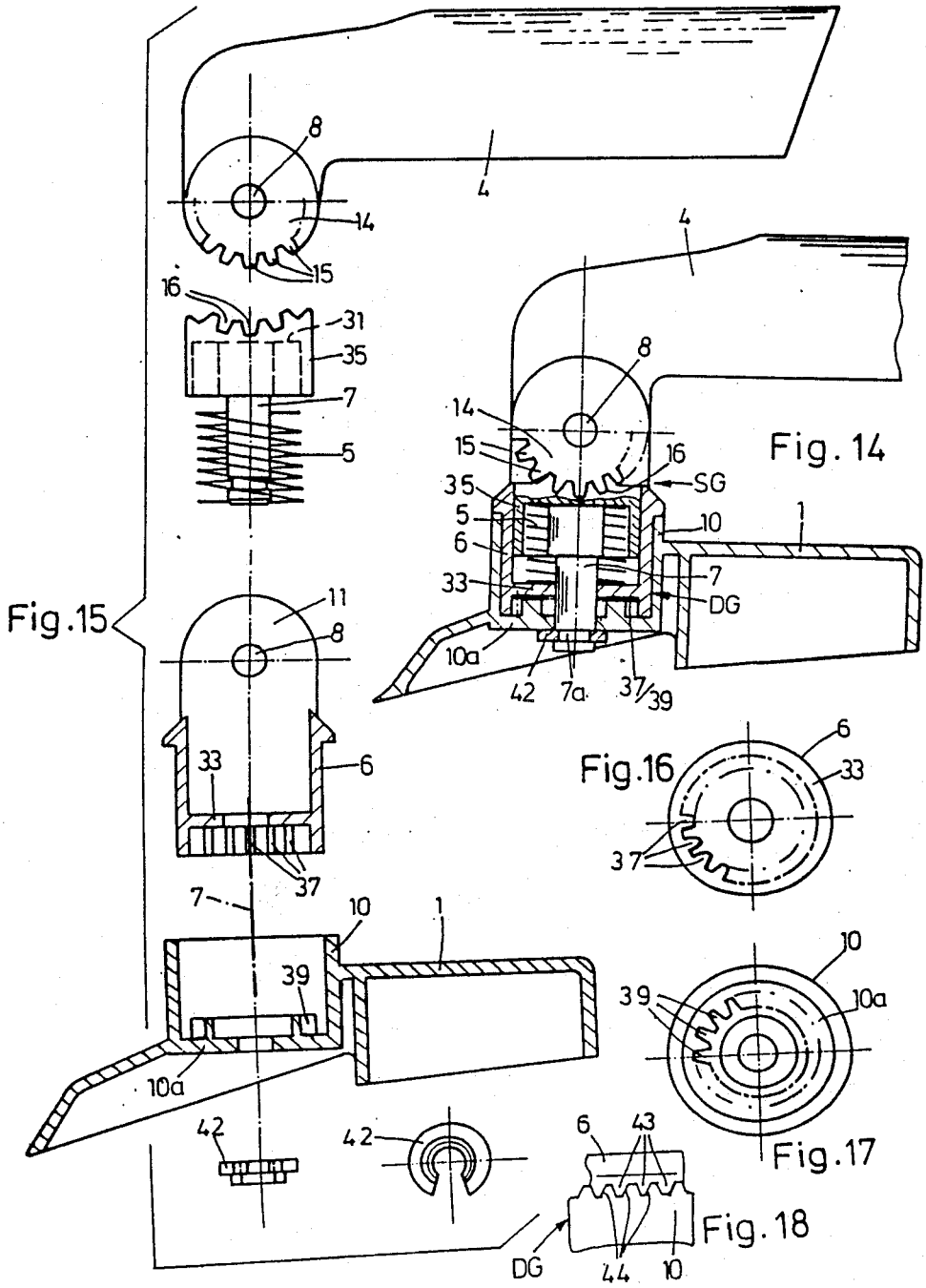
FIG. 14 is a side view, partly in section, of the hand tool with a jointed head in a modified embodiment.
FIG. 15 is a side view, partly in section and in an exploded view, showing the individual parts of the hand tool of FIG. 14.
FIGS. 16 and 17 are a view from below and from above on the cooperating, toothed bushes of the hand tool.
FIG. 18 is a side view of a portion of a further example of a locking means of the jointed head.

In the further embodiment of FIG. 18, the rotary joint (DG) may have the locking means in the upper peripheral region oriented toward the swivel joint (SG), in that teeth 43 are provided in the encompassing rim of the locking bush 6, and locking groove 44 are cut out of the bearing bush 10.

The holder 1, the handle 4, the locking bush 6 and fork portion 11 are in each case made in one piece from plastic. The bolt 47 with the abutment collar 30 and extension 34 or bush 35 can, like the lock washer 40 or the securing ring 42, be made from metal or plastic; the abutment washer 32 is of metal or plastic.

Figure 19:
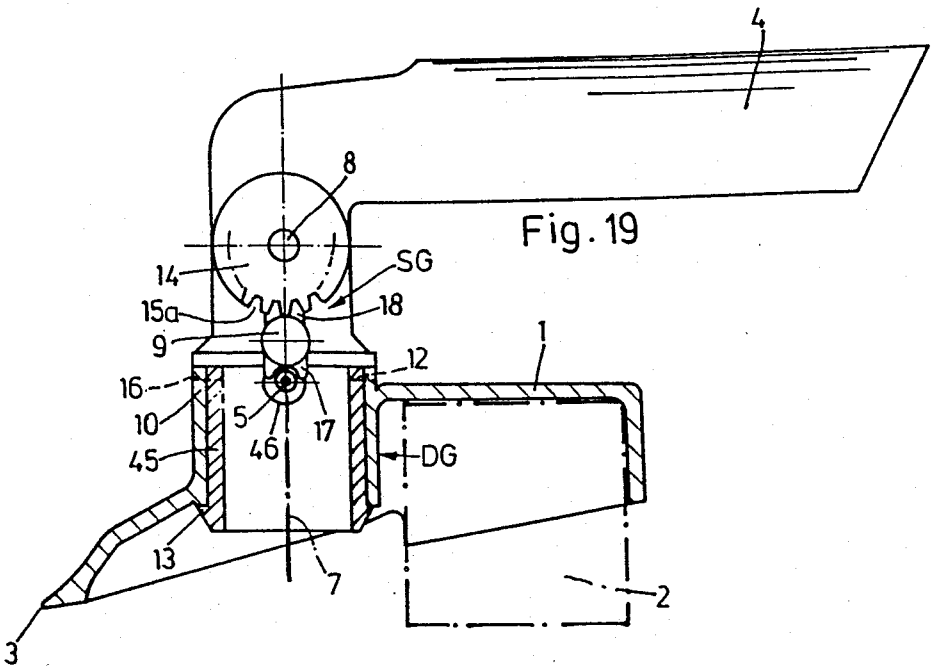
FIG. 19 is a side view, partly in section, of the manual cleaning tool with a rotary joint and a swivel joint and a spring-loaded slide.
Figure 20:
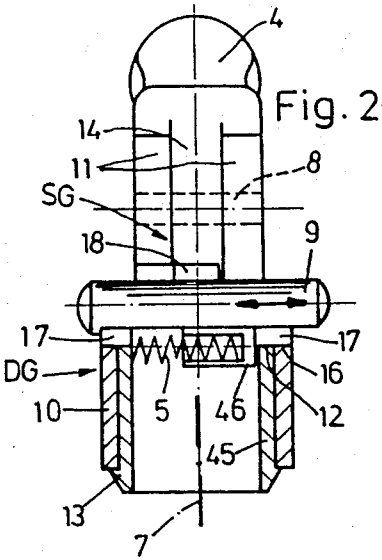
FIG. 20 is a front view, partly in section, of the rotary and swivel joint with a slide, in the slide locking position.

In the further embodiment of the hand tool of FIGS. 19 and 20, a locking and unlocking slide 9 that can be slid back and forth parallel to the axis 8 is provided between the axis 8 and the rim oriented toward it of the bearing bush 10. This slide 9 passes through the joint sleeve 45 and the bearing bush 10 and has locking ribs 17, 18, of which the locking rib or ribs 18 cooperate with the locking grooves 15a of the extension 14, and the locking rib or ribs 18 cooperate with locking grooves 16 in the bearing bush 10.

The locking grooves 16 are uniformly distributed over the circumference of the bearing bush 10, and for displacement of the slide 9 the joint sleeve 45 has guide channels 12 in which the slide 9 is supported.

The lower portion, engaging the bearing bush 10, of the joint sleeve 45 locks in detent fashion, with a detent bead 13, underneath the bearing bush 10.

The semicircular extension 14 has a plurality of grooves 15a, embodied by the teeth 15, distributed uniformly over a circular arc.

The locking and unlocking slide 9 is under the influence of a spring 5a that moves it into the locking position and holds it there.

Formed onto the locking and unlocking slide 9 is a guide 46, in the form of an abutment bush, which is engaged by the spring 5a, positionally guided by a longitudinal end region, and resting with its other longitudinal end on the joint sleeve 45. The guide 46 extends between the locking rib or ribs 17 that lock the axial rotation of the handle 4 relative to the holder 1 and extends in the longitudinal direction of the slide.

At the same time, the bush-like guide 46 forms a displacement limitation stop for the slide 9, in that in the locking position it rests on the inside against the joint sleeve 45.

The locking and unlocking slide 9 is embodied as a cylindrical bolt of circular cross section, having opposed locking ribs 17, 18 for the rotation and swiveling of joints (DG, SG).

The spring 5a is preferably embodied by a compression spring (helical spring); however, it may also be embodied as a tension spring and correspondingly secured at both ends on an abutment of the slide 9 and on the joint sleeve 45.

For adjusting the jointed head (rotary joint DG and swivel joint SG) embodied by the extension 14, the slide 9 and the joint sleeve 45 as well as by the bearing bush 10, the slide 9 is displaced by hand counter to the spring force 5a, so that its locking ribs 17, 18 are simultaneously moved out of the groove 15a, 16, and then the handle 4 is swiveled with its extension 14 about the axis 8 and with its joint sleeve 45 can be rotated in the bearing bush 10 about the axis 7 at right angles to the axis 8, which enables an infinitely adjustable angular setting of the handle 4 in two directions relative to the holder 1.

After the release of the slide 9, the slide returns automatically to the locking position by means of the spring 5*a*, and its locking ribs 17, 18 engage the grooves 15*a*, 16 and fix the handle position that has been set.

What is claimed is:

1. A hand tool for cleaning smooth surfaces, in particular panes of glass, comprising a flat-box-shaped holder; receiving a sponge block received in said holder; a squeegee spaced apart from said sponge block and parallel to it; a handle being disposed on said holder in a manner swivelable in terms of inclination and laterally about a vertical lateral swivel axis, and an inclination-adjusting axis extending parallel to said holder; two joints (SG, DG) disposed one above the other; and a common locking and unlocking element for locking both of said joints in a particular handle position including a slide provided to be displaceable parallel to the inclination-adjusting axis and swivelable with the lateral swivel axis is located between the two axes disposed spaced apart one above the other.

2. A hand tool as defined by claim 1, characterized in that said common element includes a slid and said lower joint (DG) effecting the lateral swiveling of said handle, includes a bearing body having a sleeve form about the vertical swivel axis and inserted rotatably into a bearing bush of said holder receiving said sleeve for rotation therein; a bearing fork and a guide channel for the slide protruding from said sleeve.

3. A hand tool as defined by claim 2, characterized in that a detent collar behind said bearing bush retains said sleeve of said lower joint (DG) in rotatably locked fashion.

4. A hand tool as defined by claim 2, characterized in that said upper joint (SG), effecting the inclination swiveling of the handle, has a swivel wheel, formed onto said handle and having a set of teeth on the circumference of said wheel, said swivel wheel being swivelably retained with said parallel axis in said bearing fork.

5. A hand tool as defined by claim 4, characterized in that said bearing bush , on its face end oriented toward said handle, has a plurality of grooves distributed uniformly over the circumference, and said slide, with a lower locking rib, engages at least one opposed ones of said grooves for locking said lower joint (DG), and with an upper locking rib engages in between two of said teeth on said swivel wheel, for simultaneous locking of said upper joint (SG).

6. A hand tool as defined by claim 5, characterized in that said slide has a polygonal bar cross section and on each of the two bar ends has one actuating head that, as a stop for limiting the two displacement end positions, cooperates with said guide channel, and recesses are provided between actuation heads and said two locking ribs on said slide bar, for releasing the locking positions for the adjustment motion of said two joints (SG, DG).

7. A hand tool as defined by claim 2, characterized in that said guide channel is located partly in said bearing bush and partly in said bearing fork.

8. A hand tool as defined by claim 1, characterized in that said lower joint (DG), comprises a sleeve, guide channel and bearing fork, and said upper joint (SG), comprises a swivel wheel formed onto said handle, each made in one piece of plastic, and a slide embodied as a plastic part.

9. A hand tool as defined by claim 1, characterized in that said squeegee is fixed interchangeably on said holder with a formed-on profile bead between retaining strips formed onto said holder and by means of a clamping strip of angular cross section engaging a profile bead, wherein at least two release buttons protrude at the top out of said holder and inserted into guide openings of said holder from the direction of said squeegee are formed onto said clamping strip.

10. A hand tool as defined by claim 9, characterized in that angular detent ribs gripping said clamping strip from behind and below are formed onto said holder beside said guide openings.

11. A hand tool as defined by claim 1, characterized in that said holder has two corners on the side toward said squeegee and has rim protrusions extended in curved fashion outward from said two corners, and said squeegee protrudes with its ends beyond said holder corners.

12. A hand tool as defined by claim 1, characterized in that said sponge block is embodied in one piece having two sponge portions having different firmnesses.

13. A hand tool as defined by claim 2, characterized in that said common element include a slide and a spring moves said slide into the locking position and holds it there.

14. A hand tool as defined by claim 13, characterized in that a guide in the form of an abutment bush is formed onto the slide; said spring embodied as a compression spring, engages in a positionally guided manner with one longitudinal end region of said spring, and with its other longitudinal end said spring rests on said joint sleeve.

15. A hand tool as defined by claim 14, characterized in that said guide is disposed on said slide between locking ribs that lock the axial rotation of said handle with respect to said holder, and extends in the longitudinal direction of said slide, and also forms a displacement limitation stop for said slide in the locking position.

16. A hand tool as defined by claim 1, characterized in that said common element includes a slide embodied as a cylindrical bolt of circular cross section, having opposed locking ribs for said joints (DG, SG) to lock said joints from rotation or swiveling.

17. A hand tool as defined by claim 1, characterized in that said two joints (DG, SG) can be moved into a locking position and held therein by a common spring wherein said handle is lockably connected to said holder by means of a locking bush, as a rotary joint (DG), and a locking extension, as a swivel joint (SG) and a spring is disposed about a rotary joint axis which is stationary in said holder.

18. A hand tool as defined by claim 17, characterized in that a bolt, as a rotary joint axis (7), is positionally fixed in a bearing bush (10) of said holder (1) with locking grooves (16) that cooperate with said locking extension (14) and, about which bolt said spring (5) is disposed, which is supported with one end on a bolt abutment (30/31) and with the other end on an abutment (32, 33) of said locking bush (6) which cooperates with locking means (38/39) on said side toward said holder.

19. A hand tool as defined by claim 17, characterized in that said locking extension on said handle is semicircular in embodiment, and has teeth, as locking protrusions, distributed uniformly over a semicircle, which in any swiveled handle position engage locking grooves protruding from said locking bush and recessed from an extension of said common element.

20. A hand tool as defined by claim 19, characterized in that said handle is displaceable in the longitudinal direction of a bolt in and counter to said spring in the longitudinal direction of said bolt, with said gearwheel-like locking extension of said handle and said locking bush thus joined via the swivel axis and a fork portion formed onto said locking bush, and at the same time said handle is rotatably retained in said bearing bush with said locking bush.

21. A hand tool as defined by claim 17, characterized in that said locking bush is cup-shaped in embodiment, is supported with its cup bottom at the top and bearing a formed-on fork portion, on the bolt abutment for said spring, spaced apart from a bush end open at the bottom receives a locked-in abutment washer for said spring, and at the free face end of said bush has detent protrusions in the form of ribs means oriented in the axial direction of said bush, which in every rotated position engage detent recesses, formed by holes of a lock washer fixed in said holder beneath a bearing bush.

22. A hand tool as defined by claim 21, characterized in that said lock washer overlaps an open face end, located in said holder, of said bearing bush and has a keyhole-like recess encompassing an annular groove extension of a bolt and keeps said bolt positionally fixed in said bearing bush.

23. A hand tool as defined by claim 17, characterized in that said locking bush is cup-shaped in embodiment, has a formed-on fork portion for said handle, beneath its cup bottom located at the bottom, which simultaneously forms an abutment for said spring, has an encompassing set of inside teeth on an inner toothed ring, with which in every rotated position it engages an encompassing set of outside teeth on an outer toothed ring of said bearing bush, wherein these outer teeth are formed onto the bottom of said cup-like bearing bush.

24. A hand tool as defined by claim 23, characterized in that said bolt passes through said cup bottom of said bearing bush and is fixed said bearing bush by a securing ring engaging its annular groove extension and being supported beneath said cup bottom.

25. A hand tool as defined by claim 23, characterized in that formed onto said bolt is a cup-shaped bush, which with its cup bottom located at the top forms said abutment for said spring engaging said bush and has locking grooves outside on said cup bottom.

26. A hand tool as defined by claim 17, characterized in that said locking bush has, encompassing its upper rim, a set of teeth as locking means, which engage locking grooves provided encompassing the upper rim of said bearing bush.

* * * * *

UNITED STATES PATENT AND TRADEMARK OFFICE

CERTIFICATE OF CORRECTION

PATENT NO. : 4,893,370

DATED : January 16, 1990

INVENTOR(S) : Manfred Klotz

It is certified that error appears in the above-identified patent and that said Letters Patent is hereby corrected as shown below:

Column 1, line 63, delete "he" and insert --the--

Column 4, line 42, delete "12" and insert --11--

Signed and Sealed this

Thirtieth Day of July, 1991

*Attest:*

*Attesting Officer*

HARRY F. MANBECK, JR.

*Commissioner of Patents and Trademarks*